US006986644B2

(12) United States Patent
Shaw

(10) Patent No.: US 6,986,644 B2
(45) Date of Patent: Jan. 17, 2006

(54) HARD MATERIAL IMPELLER AND METHODS AND APPARATUS FOR CONSTRUCTION

(75) Inventor: James Shaw, Draper, UT (US)

(73) Assignee: Envirotech Pumpsystems, Inc., Salt Lake City, UT (US)

( * ) Notice: Subject to any disclaimer, the term of this patent is extended or adjusted under 35 U.S.C. 154(b) by 201 days.

(21) Appl. No.: 10/428,581

(22) Filed: May 2, 2003

(65) Prior Publication Data

US 2004/0219021 A1 Nov. 4, 2004

(51) Int. Cl.
*B63H 1/16* (2006.01)
*B21D 53/78* (2006.01)

(52) U.S. Cl. ..... 416/185; 416/223 R; 29/889; 29/889.722

(58) Field of Classification Search ..... 416/185, 416/223 R; 29/889, 889.722
See application file for complete search history.

(56) References Cited

U.S. PATENT DOCUMENTS

| | | | | |
|---|---|---|---|---|
| 2,887,744 | A | 5/1959 | Holliday | |
| 3,139,890 | A * | 7/1964 | Moran | 134/100.1 |
| 4,479,293 | A * | 10/1984 | Miller et al. | 29/889.23 |
| 4,732,541 | A * | 3/1988 | Hyll | 416/186 R |
| 4,827,589 | A * | 5/1989 | Friedrichs | 29/889.2 |
| 5,752,803 | A * | 5/1998 | Wetzel et al. | 415/182.1 |
| 6,276,899 | B1 * | 8/2001 | Lambert et al. | 416/186 R |

* cited by examiner

*Primary Examiner*—Hoang Nguyen
(74) *Attorney, Agent, or Firm*—Morriss O'Bryant Compagni, P.C.

(57) ABSTRACT

Methods of producing impeller castings from very hard materials are disclosed in which the formation of a selectively configured core produces an impeller casting that does not need to be machined to receive the drive shaft and eliminates the need for employing a lead babbitt or soft insert, as is known in the prior art, to receive the drive shaft, thereby producing a hard material impeller for a centrifugal pump that is significantly less costly to produce and is environmentally safe.

38 Claims, 9 Drawing Sheets

HARD MATERIAL IMPELLER AND METHODS AND APPARATUS FOR CONSTRUCTION

BACKGROUND OF THE INVENTION

1. Field of the Invention

This invention relates to impellers of centrifugal pumps used in industrial applications. More specifically, this invention relates to impellers made of very hard materials which are conventionally structured with a lead babbitt to receive a drive shaft. The present invention provides structures and methods for eliminating the babbitt to provide an impeller that is environmentally safe and less expensive to produce.

2. Description of Related Art

Certain industrial processes involve the pumping of extremely abrasive materials. Such industrial processes include, for example, raw sewage treatment and mining and dredging where the slurries being pumped contain highly abrasive solids. While all pumps that process slurries are eventually subject to wear and degradation, those pumps that are used to process highly abrasive slurries are susceptible to faster and more significant degradation.

Responsive to the wear imposed by processing such highly abrasive slurries, pump impellers have been made of more durable material to withstand the wear. Many such impellers, for example, are made from very hard metals selected to be harder than the most common and abrasive grit particle, which is silica sand. The materials are generally selected, therefore, to have a hardness greater than 570 Bhn on the Brinell Hardness scale, or the equivalent thereof. Materials having a hardness greater than 570 Bhn include Ni-Hard and Hi-Chrome. The use of hard materials in the formation of pump impellers significantly improves the life of the impeller, but also imposes difficulties in the manufacture of the impeller.

Pump impellers are typically rotated within a pump casing by connection to the drive shaft of a motor. Impellers are generally formed with a central cavity or opening into or through which the terminal end of the drive shaft extends. The exact design and construction of the connection of the impeller to the drive shaft varies widely between types and models of impellers. Impellers that are made of softer metals may typically be machined to form a central cavity that will accommodate the end of the drive shaft. However, impellers that are made of very hard materials (i.e., greater than 570 Bhn), are very difficult to machine and, therefore, present a problem with fitting the drive shaft to the impeller.

It has been the conventional practice with very hard material impellers to form a babbitt in the central cavity of the impeller to receive the terminal end of the drive shaft. The babbitting is typically lead and the softness of the lead babbitt allows it to conform to the drive shaft to provide comprehensive contact between the babbitt and the drive shaft. The babbitt may be formed with a given configuration to accommodate the drive shaft.

In known casting techniques, the impeller is made in a mold which is shaped to produce a central cavity in the impeller. The central cavity of the casting is of imprecise dimension and finish which is permissible since the babbitt formed in the central cavity compensates for any dimensional or finishing imprecisions. Once the molten material of the impeller has hardened and the casting is removed from the mold, the central cavity is ready for the formation of the babbitt. The center of the cavity is determined and a post-like implement or mandrel is positioned at the center of the cavity. Molten lead is then poured into the cavity and around the mandrel. When the lead has hardened, the mandrel is removed. The babbitt may be formed with a particular shape that is dictated, at least in part, by the machining of the end of the drive shaft.

The need to use a lead babbitt, necessitated by the extreme hardness of the impeller material, results in significant additional labor which increases the time and cost of manufacturing hard material impellers. More importantly, however, is the fact that lead babbitts cannot be used in many applications because the lead seeps into and contaminates the water being processed. Also, formation of the lead babbitt is a very toxic and dangerous process and is very costly as a result.

An alternative method of mounting very hard material impellers to drive shafts is to provide a soft metal insert into the center of the impeller mold prior to pouring the molten material to form the impeller. The soft metal insert can be configured to provide contact with the impeller and to accommodate the drive shaft, but is also machined to receive the drive shaft. Soft inserts are used when the type of fluid being pumped is incompatible with the lead of a babbitt. The use of soft inserts, however, also represents added cost and labor to the manufacture of the impeller because of the machining required to manufacture the insert and the additional machining required to form the insert to the drive shaft.

Thus, it would be advantageous in the art to provide means for producing impellers from hard material which eliminates the need for a lead babbitt or any other type of insert to accommodate the drive shaft and which eliminates the need to machine the impeller or drive shaft, significantly reduces manufacturing costs, simplifies manufacture and provides a more environmentally safe impeller of very hard material.

BRIEF SUMMARY OF THE INVENTION

In accordance with the present invention, a centrifugal pump impeller formed from very hard materials is made in a manner which eliminates the need for a lead babbitt or other insert, and further eliminates the need to machine the impeller to receive the drive shaft, thereby reducing the cost of manufacturing and producing an environmentally-safe impeller. The impeller of the present invention is particularly configured to receive the terminal end of a drive shaft to provide comprehensive contact between the impeller and the drive shaft to improve the operational life of the drive shaft and the impeller. While the configuration and method of forming a hard material impeller in accordance with the invention is adaptable to any type or style of hard material impeller, the invention is described herein with respect to vortex type impellers as merely one exemplar application of the invention.

In accordance with the present invention, impellers formed of very hard material having a Brinell Hardness number of equal to or greater than 570 Bhn, or the equivalent thereof, are made by methods that provide an impeller having a central cavity that is ready to receive the terminal end of a motor drive shaft without requiring machining or the formation of a babbitt.

Prior art methods of making impellers of very hard material produce an impeller having a central cavity that is of imprecise dimension and finish. Such imprecision is not critical in prior art casting methods because machining and the babbitt formed in the central cavity will compensate for such imprecisions. In the present invention, use of a babbitt, soft inserts and the machining of the impeller casting is eliminated by forming the central cavity of the impeller with a selected configuration and finish during the casting process so that the central cavity is ready to receive the drive shaft following casting of the impeller. In the methods of the present invention, an impeller mold is used which has a core of selected configuration and finish which renders the central opening of the impeller casting ready to receive the terminal end of the drive shaft. The need for machining the casting or employing a lead babbitt is eliminated.

The core of the present invention which is used to form the impeller casting comprises a generally cylindrical form that is structured for attachment to the box in which the impeller mold is formed for casting the impeller. The configuration of the core is selected to determine the ultimate configuration of the central opening in the cast impeller which will receive the drive shaft. The configuration of the core, while variable, is formed with a portion that provides at least one contact surface in the central opening of the impeller for contacting the drive shaft. The core may also be formed with a portion that shapes the impeller in a manner that facilitates the attachment of the drive shaft to the impeller in assembly of the pump. The core may also be selectively formed from materials that will provide a desired finish to the interior wall of the central opening of the impeller.

Impellers of the present invention formed by the described methods may be configured in a number of ways to receive a drive shaft of a given configuration. A number of configurations may be used that improve the operational life of the impeller and drive shaft as compared to prior art impeller and drive shaft arrangements. Various embodiments of the cores and the impellers made by such cores are described herein in accordance with the invention.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
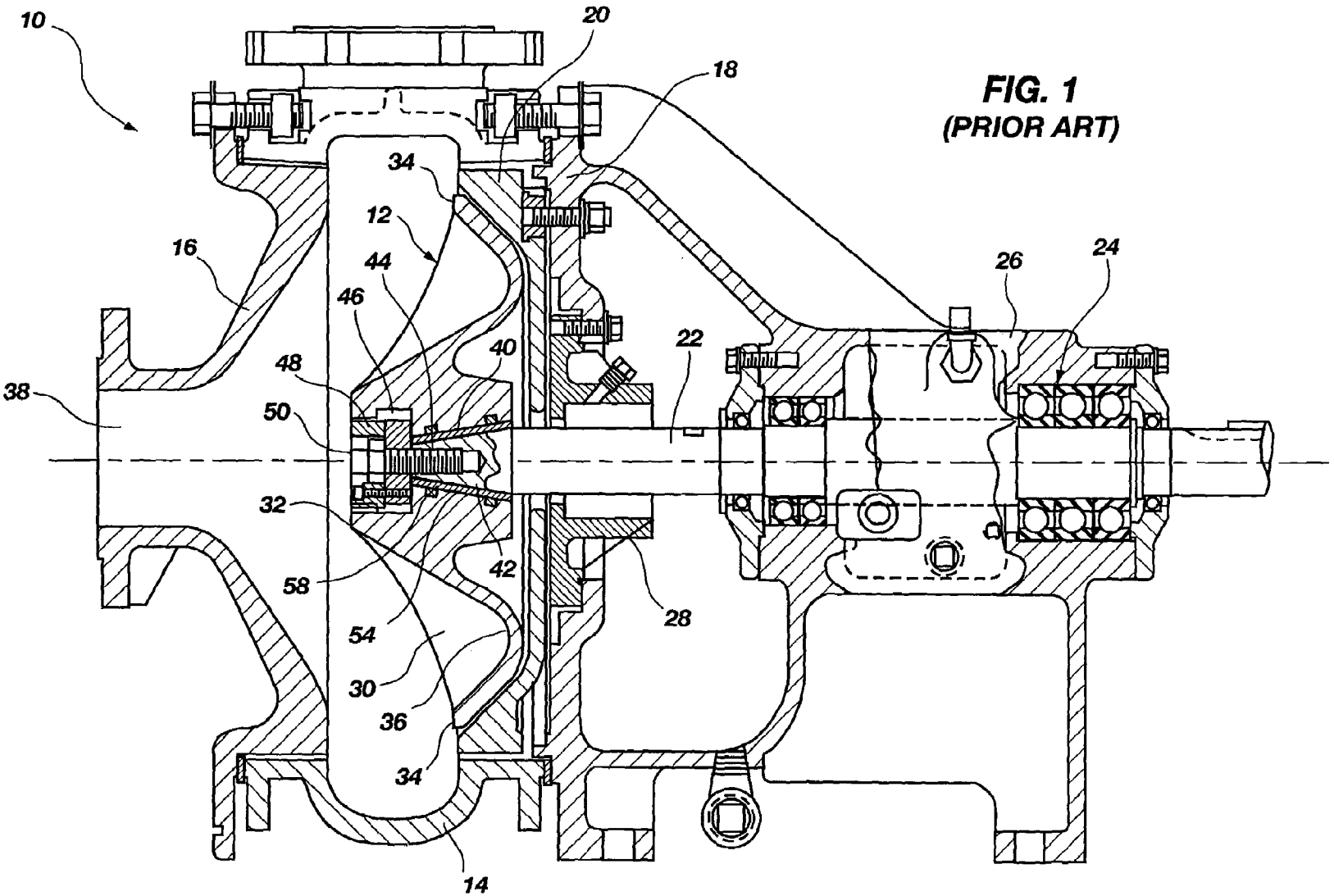
FIG. 1 (PRIOR ART)
FIG. 1 is a view in cross section of a vortex impeller pump of the prior art illustrating the use of a lead babbitt.

FIG. 1 illustrates, for reference purposes, a known centrifugal pump 10 having a vortex-type impeller 12. The pump 10 generally comprises a pump casing 14 having a suction side wear plate 16 and a drive side casing 18 which enclose the impeller 12. In this particular kind of pump 10, the impeller 12 is cradled in a suction side wear plate 20 that is secured to the drive side casing 18. A drive shaft 22 extends through the drive side casing 18 and is supported by a bearing system 24 positioned within a bearing housing 26. A seal assembly 28 (only partially depicted) also surrounds the drive shaft 22 at the drive side casing 18.

Figure 2:
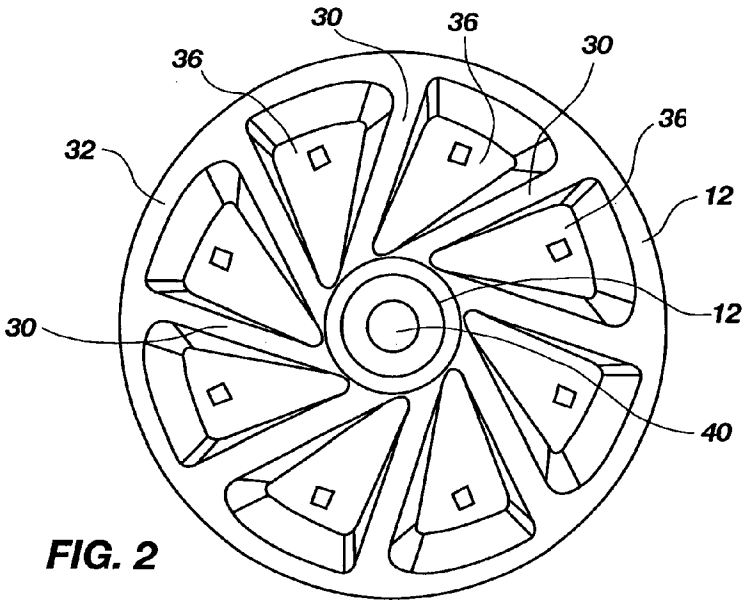
FIG. 2 is a view in elevation of the suction side of a vortex impeller of the type shown in FIG. 1.

The impeller 12 illustrated in FIGS. 1 and 2 is structured with a plurality of upstanding vanes 30 which each extend from a suction side hub 32 to a circumferential rim 34. Cupped portions 36 are formed between adjacent vanes 30 and the circumferential rim 34. The cupped portions 36 receive fluid entering into the pump 10 through the pump inlet 38.

An opening 40 is formed through the center of the impeller 12 to accommodate the drive shaft 22. More specifically, the opening 40 may be considered to have a drive side portion 42, which is sized to receive the terminal end 44 of the drive shaft 22, and a suction side portion 46 formed in the hub 32 of the impeller. The suction side portion 46 of the opening 40 is generally sized to receive a lock nut assembly 48 and bolt 50 which fits through the lock nut assembly 48 and threadingly engages the terminal end 44 of the drive shaft 22 as shown.

The illustrated prior art impeller 12 of FIG. 1 is made in a conventional manner well-known in the art which involves the formation of a mold into which molten material is poured to form the impeller casting. The mold, comprising two halves, is made by securement of a wooden and/or plastic pattern of the impeller to a platform followed by the placement of a box about the pattern. The pattern determines the outer configuration of the impeller but also produces a centered cavity for later defining of the central opening 40 of the impeller.

Fluidized sand containing a binder is packed into the two halves of the mold box and around the impeller pattern. When the sand has hardened, the impeller pattern is removed from the mold halves leaving an impeller impression. A core made of sand is connected to one of the two halves of the box and is centrally located within the centered cavity in the impeller impression. The core is of generalized shape and imprecise dimension. The two halves of the impeller mold are then secured together with the centrally-positioned core attached to the box and molten material, such as Ni-Hard, is poured into the mold to form the cast impeller. After the molten material has cooled, the two halves of the mold are removed from about the impeller casting and the core is removed.

It should be noted at this point that in such prior art casting techniques, the core, by virtue of its mode of placement and attachment to the impeller mold, is not entirely secured within the mold and the core may shift as the molten material is being poured into the impeller mold. A core shift of plus or minus one sixteen of an inch from the center line of the impeller is allowable within the industry because it can be compensated for by the lead babbitt described hereinafter and will allow the impeller to rotate without adverse affect. Core shifts of greater than that amount produce an impeller casting that cannot be used because the impeller will wobble when it rotates.

The conventional casting process as described produces a central opening 40 in the prior art impeller casting 12 which is of imprecise configuration, dimension and interior finish, rendering it unsuitable to receive the terminal end 44 of the drive shaft 22. The imprecision of the central opening 40 is compensated for, however, by use of a relatively soft lead babbitt 54, as shown in FIG. 1, which allows the babbitt 54 to conform to the drive shaft 22. The central opening 40 may be cast with a certain configuration which, in this example, includes a plurality of axial and radial grooves 58 which receive the lead babbitting.

A mandrel-type tool, the shape of which is identical to the terminal end 44 of the drive shaft 22, is positioned in the opening 40. Molten lead is then poured into the opening around the mandrel-type tool. The molten lead fills the axial and radial grooves 58 formed in the impeller 12 and hardens to form the babbitt 54. The mandrel-type tool is removed and the resulting opening is ready to receive the terminal end 44 of the drive shaft 22. In the prior art impeller 12, the soft lead babbitt 54 conforms to the shape of the terminal end 44 of the drive shaft 22. The lead babbitt 54 eventually deforms or deteriorates over time and is no longer operative. A new lead babbitt 54 must then be poured to continue use of the impeller.

In accordance with the present invention, an impeller is manufactured from very hard materials in a manner which eliminates the need to machine the impeller or to employ a babbitt, thereby rendering the impeller environmentally-safe and considerably less expensive to produce. Impellers of the present invention are produced by preparing a two part impeller mold from sand in the conventional manner previously described. However, in the present invention, a selectively configured and precisely-formed core is used in the impeller mold so that the resulting impeller casting has a central opening which is precisely configured to render it suitable for direct attachment to the drive shaft. The need to machine the central opening or employ a babbitt is thereby eliminated. In addition to being selectively configured, the core is made of a selected material that produces a relatively smooth surface, or interior wall of the central opening of the impeller, to further eliminate the need for any machining or finishing.

Figure 3:
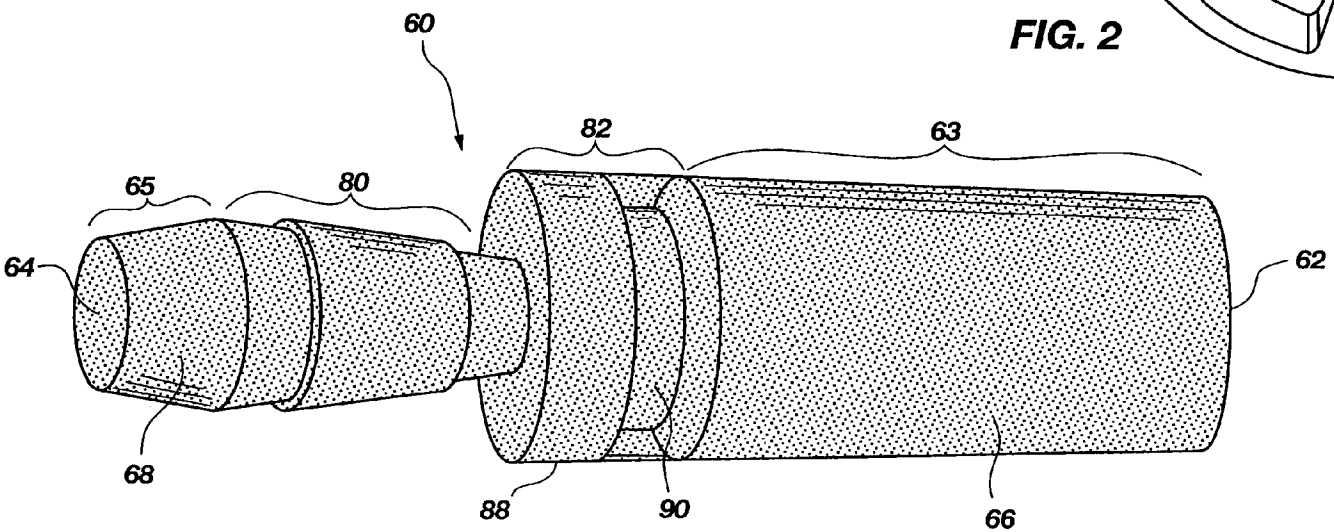
FIG. 3 is a perspective view of a core used in accordance with the invention to form an impeller of the invention.

FIG. 3 illustrates one exemplar core 60 used in the process of the present invention. The core 60 is illustrated as being made of sand, but the core 60 may be made of any other material, including ceramic material, that is capable of being formed into a selected configuration and is able to withstand contact with the molten material used to form the impeller. Moreover, the material used to form the core 60 may be particularly selected to produce an interior surface in the central opening of the impeller casting which has a desired character of finish. Thus, for example, a sand of a particular grain size may be particularly selected to achieve a desired finish in the impeller casting.

As one exemplar means of forming the core 60, a mold, or core box, is formed using two plates of cast iron that are suitably machined to form the structural members of the core box. The two plates are drilled and pinned, and the mating surfaces of the two halves are ground to assure that when the two halves of the core box are separated and then rejoined, the halves will mate precisely.

A cavity or impression is machined into each half of the core box corresponding to one lateral half of the finished core configuration. The two halves of the core box are joined and the shape of the cavity or impression is checked to assure that the impression is will accurately produce the desired shape or configuration of the finished core. Additional machining is then performed on the core box halves to enable sand to be blown into the core box.

The core box is mounted in a machine that heats the two halves of the core box. Fluidized sand containing a binder is then blown into the core box. The heat of the cast iron core box causes the binder to solidify the sand. The two halves of the core box are then separated and the finished sand core is removed. The finished core 60, an example of which is shown in FIG. 3, is then ready for use in formation of the impeller casting.

The impeller of the present invention, as shown generally in FIG. 7 and described more fully hereinafter, may be cast in a sand mold or other suitably formed mold. The mold, comprising two halves, is formed by securement of a wooden or plastic pattern of the impeller on a platform and the pattern is then surrounded by a box as is done in conventional mold-forming methods. However, in accordance with the present invention, the impeller pattern used in making the impeller mold is especially structured to produce two centralized cavities which will receive the ends of the core 60 to stabilize the core 60 within the center of the impeller impression while the molten material is being poured into the mold to form the impeller casting.

Referring to FIG. 3, it can be seen that the first end 62 of the core 60 has associated therewith an elongated cylindrical section 63 and the second end 64 of the core 60 has associated therewith a frustoconically-shaped section 65. The cylindrical section 63 and frustoconically-shaped section 65 constitute, respectively, a first core print 66 and a second core print 68. In a particularly suitable embodiment, the length of the first core print 66 may be between three and about five times the length of the second core print 68. The pattern that is used to form the impeller impression in the mold box is specifically structured to form two centralized and axially aligned core print cavities in the mold halves to accommodate the first core print 66 and second core print 68, as described hereinafter.

When casting the impeller, the bottom half of the mold box is placed on a surface and the first core print 66 is positioned within the core print cavity that is formed in that half of the mold box. The selected shape, length and taper of the first core print 66 assure that the core 60 will be securely positioned within the mold box and along the center line of the mold to prevent shifting of the core 60. The second half of the mold box is then positioned above the bottom half of the mold box and the core point cavity that is formed in the second, or upper, half of the mold box is aligned to receive the second core print 68. Again, the selected shape, length and taper of the second core print 68 facilitates the accurate placement and alignment of the top mold half on the bottom mold half and assures the securement of the core 60 along the center line of the impeller impression provided by the mold. Moreover, the length and taper of the first core print 66 provide alignment and stability to the core 60 during placement of the top half of the mold on the bottom half of the mold.

The selectively configured core 60, therefore, provides an improvement in the art of hard material impeller casting in that it assures that a precisely centered and configured central opening will be formed in the impeller casting for immediate receipt of the drive shaft. No compensation need be made with respect to the central opening of the impeller, such as machining or use of a babbitt or soft insert, to assure that the impeller will adequately receive the drive shaft or to assure that the impeller will rotate correctly.

Figures 7, 8, 9, 12, 13:
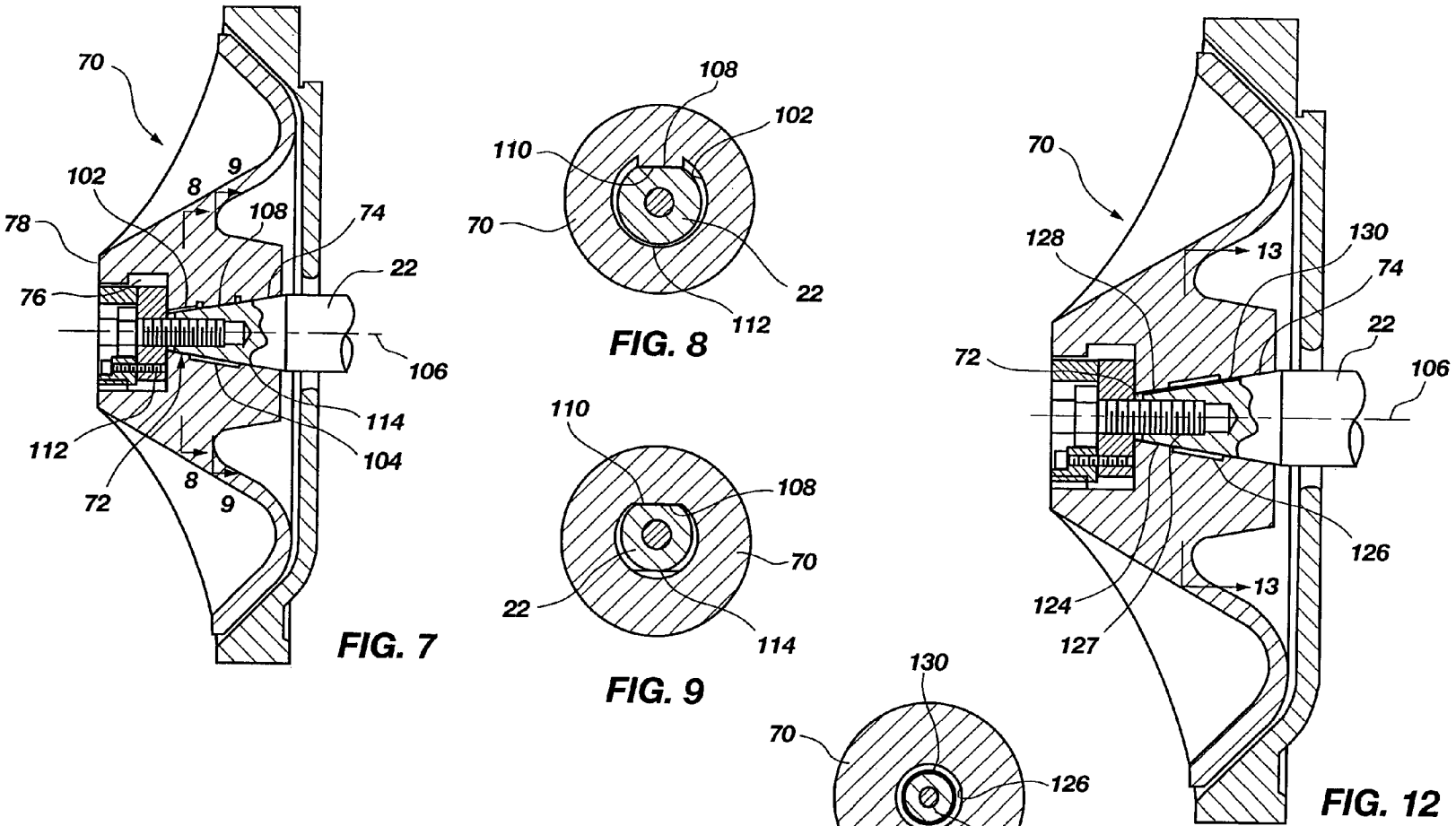
FIG. 7 is a view in radial cross section of an impeller of the present invention, the central opening of which is configured by the core configuration shown in FIGS. 4–6.
FIG. 8 is a view in axial cross section of the impeller shown in FIG. 7 taken at line 8—8 thereof.
FIG. 9 is a view in axial cross section of the impeller shown in FIG. 7 taken at line 9—9 thereof.
FIG. 12 is a view in radial cross section of an impeller, the central opening of which is formed by the core embodiment shown in FIGS. 10 and 11.
FIG. 13 is a view in axial cross section of the impeller shown in FIG. 12 taken at line 13—13 thereof.

FIG. 7 illustrates an impeller 70 of the present invention that is cast by the described method of the present invention. The impeller 70 is similar in overall shape to the prior art impeller 10 shown in FIG. 1, except that the central opening 72 of the new impeller 70 is configured differently in accordance with the invention, as described more fully hereinafter. The vortex impeller 70 of the present invention has a central opening 72 which, similar to the prior art impeller 10, may be designated as having a drive side portion 74 which is sized to receive the drive shaft 22 and a suction side portion 76 formed in the hub 78 of the impeller 70. The drive side portion 74 of the central opening 72 has a configuration selected for accommodation of the drive shaft 22 and the configuration of the drive side portion 74 is provided by the particular configuration of the core 60, as described more fully hereinafter.

Referring again to FIG. 3, the core 60 of the present invention comprises at least one configured region which is selectively shaped and dimensioned to determine the configuration and dimension of the central opening 72 of the cast impeller 70. Accordingly, a first region 80 of the core 60 dictates the configuration and dimension of the drive side portion 74 of the central opening 72. The configuration of the first region 80 may vary depending on the shape of the terminal end of the drive shaft and on the desired contact between the central opening 72 and drive shaft.

A second region 82 of the core 60 may also be provided to determine the configuration of the suction side portion 76 of the central opening 72. Consistent with the vortex-type impeller illustrated in FIG. 7, the second region 82 of the core 60 may be formed with a first cylindrical portion 88 having a selected circumferential dimension and a second cylindrical portion 90 having a circumferential dimension that is less than the circumferential dimension of the first cylindrical portion 88. The resulting impeller casting is provided with a suction side portion 76 which accommodates a bolt and lock nut assembly of the type shown in FIG. 1. It should be noted that some hard material impellers may not be formed with a suction side portion 76 as illustrated in the vortex-type impeller shown herein and a core used to form such impellers would lack a second region 82 as described.

Figure 4:
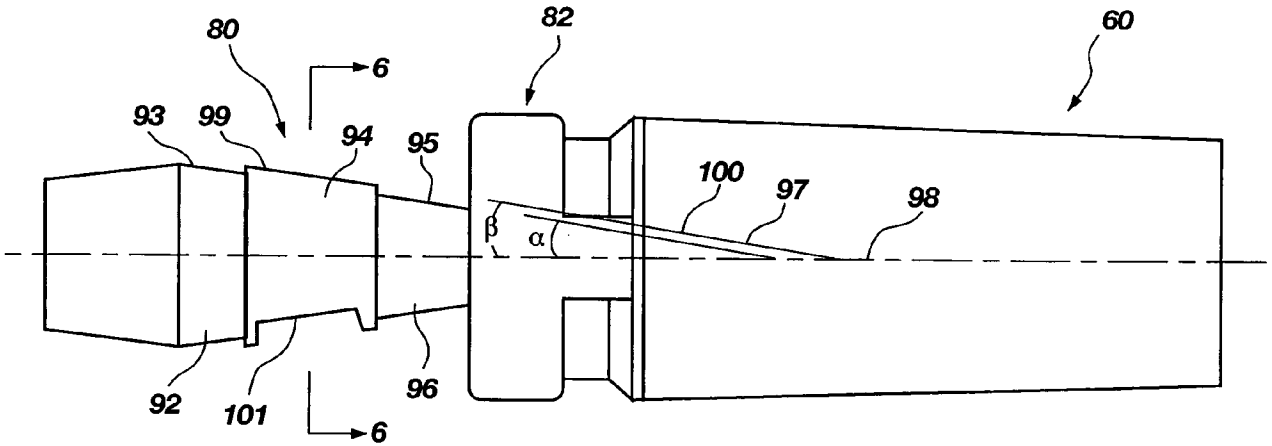
FIG. 4 is a view in elevation of a first embodiment of the core of the invention.
Figure 5:
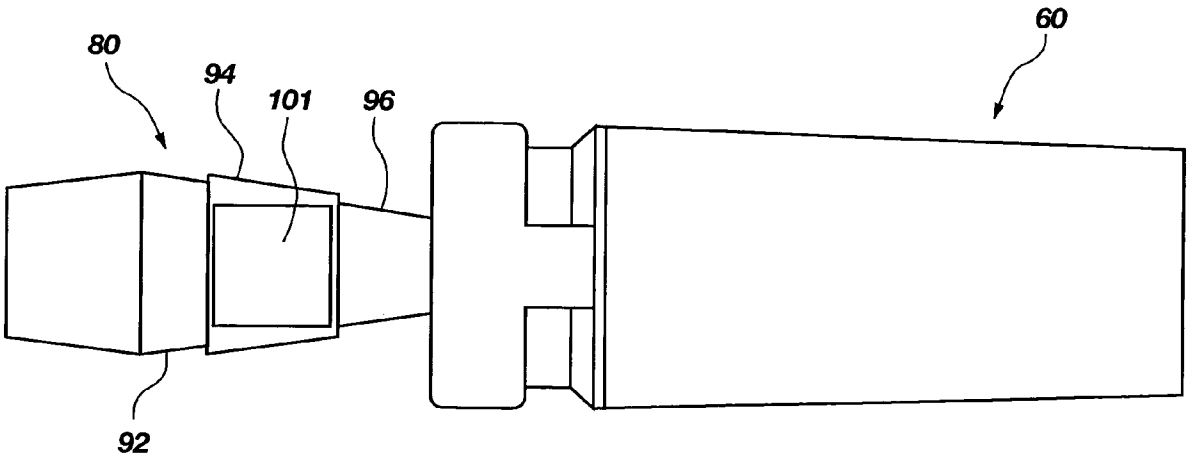
FIG. 5 is a view in elevation of the core illustrated in FIG. 4, the core having been rotated counterclockwise on its axis ninety-degrees.
Figure 6:
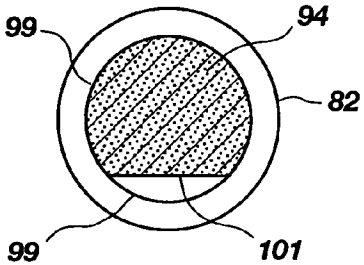
FIG. 6 is a view in cross section of the core illustrated in FIG. 4 taken at line 6—6 thereof.

FIGS. 4–6 illustrate a first embodiment of the core 60 of the present invention where the first region 80 of the core 60 has a first selected configuration. It should be noted that the configuration and dimension of the second region 82 of the core 60 which ultimately determines the configuration and dimension of the suction side portion 76 of the central opening 72 of the impeller 70 may be presumed henceforth to be the same throughout the various embodiments of the core 60 and impeller 70 hereinafter described.

In FIG. 4, the first region 80 of the core 60 has a configuration which is generally conical in shape to receive a similarly shaped drive shaft. More specifically, the configuration of the first region 80 is comprised of a first conical portion 92, a second conical portion 94 and a third conical portion 96. The surface 93 of the first conical portion 92 and the surface 95 of the third conical portion 94 may, in a preferred embodiment, both lie in a plane 97 that intersects a plane through the axis 98 of the core 60 at an angle $\alpha$ thereto. The angle $\alpha$ of the plane 97 may, most suitably, be from about five degrees to about ten degrees. The surface 93 of the first conical portion 92 and the surface 95 of the third conical portion 96 need not lie in the same plane, however.

The surface 99 of the second conical portion 94 is spaced from the surfaces 93, 95 of the first conical portion 92 and third conical portion 96, respectively. The surface 99 of the second conical section 94 lies in a plane 100 which intersects a plane formed through the axis 98 of the core 60 at an angle $\beta$. Where the surface 99 of the second conical portion 94 is parallel to surfaces 93 and 95, which may be preferred, angle $\beta$ is equal to angle $\alpha$ and, therefore, may range from about five degrees to about ten degrees.

A flat, indented portion 101 is formed in the second conical portion 94 of the core 60, as best seen in FIGS. 5 and 6. Thus, the second conical portion 94 is not entirely conical throughout its length, as illustrated in FIG. 6. The flat, indented portion 101 of the core 60 provides a flat surface in the cast impeller for contacting a corresponding flat surface formed in the terminal end of the drive shaft. FIG. 7 illustrates the configuration of the drive side portion 74 of the central opening 72 that is produced by the core 60 configuration shown in FIGS. 4–6. The resulting central opening 72 has a first tapered surface 102 and a second tapered surface 104 which is spaced from the first tapered surface 102 in a direction away from the axis 106 of the impeller 70 and drive shaft 22.

As best seen in FIGS. 8 and 9, the flat, indented portion 101 of the core 60 produces a corresponding flat surface 108 in the central opening 72 of the impeller 70 which is spaced generally radially inward from the first tapered surface 102 of the central opening 72. The drive shaft 22 has a corresponding flattened surface 110. It can be seen in FIGS. 7–9, that the drive shaft 22 contacts the first tapered surface 102 of the central opening 72 at contact points 112 and 114 located on either side of the second tapered surface 104. Friction between the drive shaft 22 and the impeller 70 at the contact points 112, 114 of the central opening 72 provide a primary drive mechanism for rotation of the impeller 70. The rough casting of the impeller at the contact points 112, 114 allows the impeller to embed into the metal of the drive shaft 22 providing greater gripping potential for rotation of the impeller 70. The contact between the flat surface 108 of the central opening 72 and the flattened surface 110 of the drive shaft 22 provides a secondary drive mechanism for rotating the impeller 70. Therefore, the configuration provides improved operational life of the impeller and drive shaft.

Figure 10:
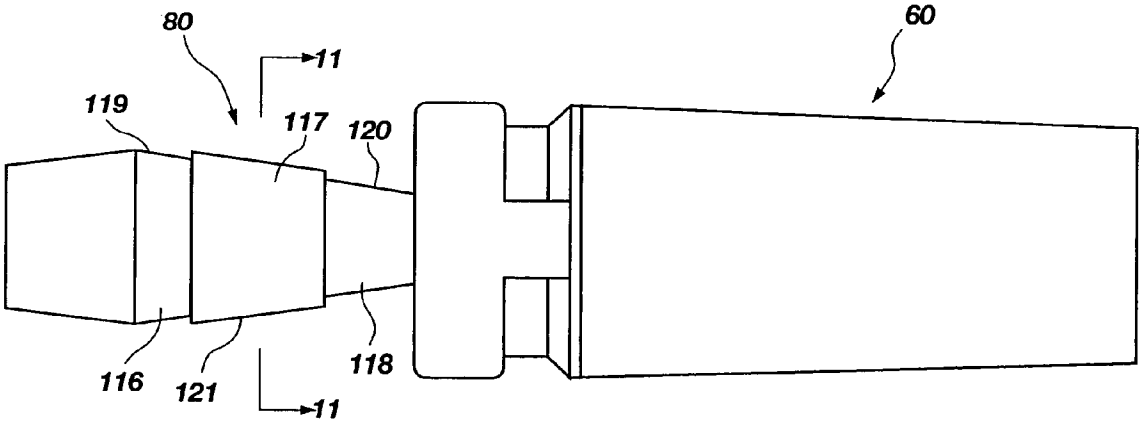
FIG. 10 is a view in elevation of a second embodiment of the core of the present invention.
Figure 11:
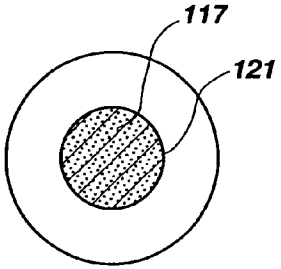
FIG. 11 is a view in axial cross section of the core embodiment shown in FIG. 10 taken at line 11—11 thereof.

FIG. 10 illustrates a second alternative embodiment of the core 60 of the present invention where, again, the first region 80 is generally conical in shape and the configuration is comprised of a first conical portion 116, a second conical portion 117 and third conical portion 118. The surface 119 of the first conical portion 116 and the surface 120 of the third conical portion 118 may preferably lie in the same plane as described for the first core embodiment of FIG. 4. The surface 121 of the second conical portion 117 is spaced from the surfaces 119, 120 of the first conical portion 116 and third conical portion 118, respectively. The second embodiment of the core 60 illustrated in FIG. 10 is similar to that shown in FIG. 4, except that the first region 80 is configured without a flat surface. FIG. 11 further illustrates that the second conical portion 117 has a circular circumference in axial cross section.

FIG. 12 illustrates an impeller 70 having a drive side portion 74 of the central opening 72 that is formed by the core 60 shown in FIG. 10. The resulting central opening 72 is configured with a first tapered surface 124 and a second tapered surface 126 which is spaced from the first tapered surface 124 in a direction away from the axis 106 of the impeller 70 and drive shaft 22. The drive shaft 22 is configured with a conically-shaped terminal end 127 (i.e., having no flattened surface) having essentially the same angle of taper as the first tapered surface 124 of the central opening 72. Consequently, the drive shaft 22 contacts the first tapered surface 124 of the central opening 72 at at least two points, namely a first contact point 128 and second contact point 130 located on either side of the second tapered surface 126, which provides greater gripping potential for rotation of the impeller 70.

Figure 14:
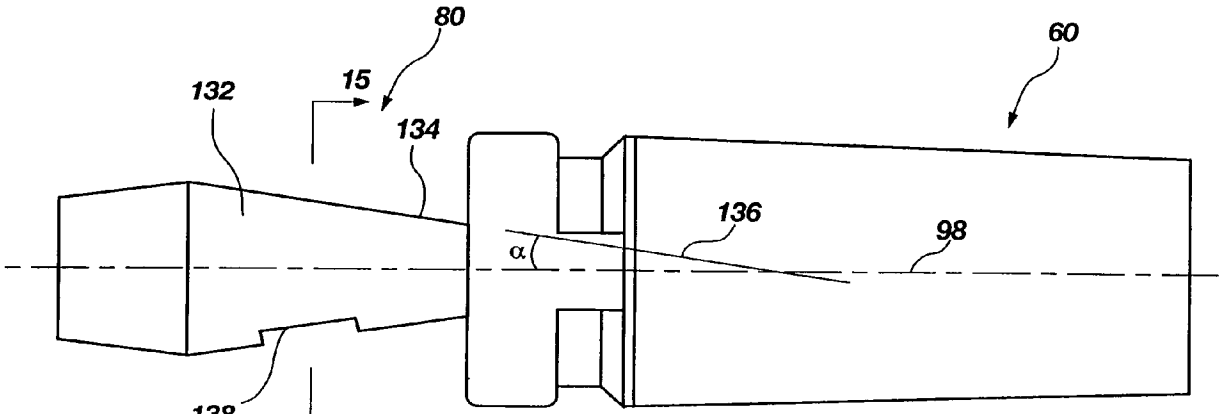
FIG. 14 is a view in elevation of a third embodiment of the core of the present invention.

FIG. 14 illustrates a third embodiment of the core 60 of the present invention where the first region 80 of the core is generally conically shaped with a single conical portion 132. The single conical portion 132 has a surface 134 which lies in a plane 136 that intersects a plane formed through the axis 98 of the core 60 at an angle $\alpha$. The angle $\alpha$ may be from about five degrees to about ten degrees. An indented flat surface 138 is formed in the surface 134 of the single conical portion 132, as best seen in FIG. 15.

Figure 15:
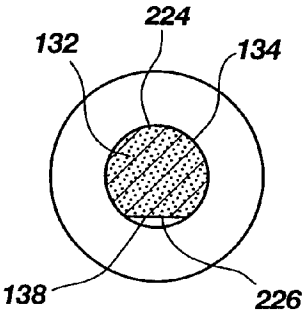
FIG. 15 is a view in axial cross section of the core shown in FIG. 14 taken at line 15—15 thereof.
Figure 17:
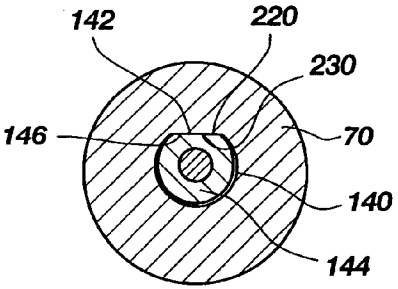
FIG. 17 is a view in axial cross section of the impeller shown in FIG. 16 taken at line 17—17 thereof.
Figure 16:
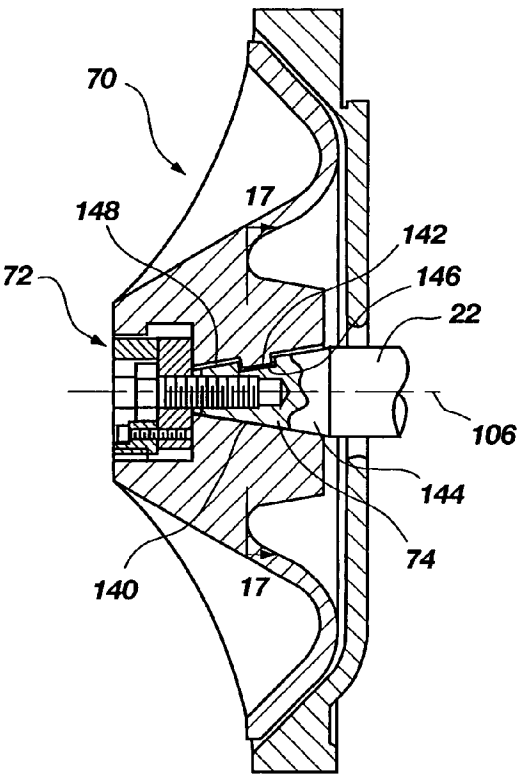
FIG. 16 is a view in radial cross section of an impeller, the central opening of which is configured by the core shown in FIGS. 14 and 15.

FIG. 16 illustrates an impeller 70 of the present invention, the central opening 72 of which is formed by the core 60 shown in FIGS. 14 and 15. The drive side portion 74 of the central opening 72 is configured with a tapered surface 140 and a flat surface 142 formed along a portion thereof. The terminal end 144 of the drive shaft 22 is similarly configured with a conical shape having a flattened surface portion 146 that is positioned to contact the flat surface 142 of the drive side portion 74 when the drive shaft 22 is connected to the impeller 70. As seen in FIGS. 16 and 17, this embodiment of the impeller 70 produces contact between the drive side portion 74 of the central opening 72 and the terminal end 144 of the drive shaft 22 virtually everywhere, except at a point 148 on one side of the flat surface 142 of the central opening 72. As such, the fit between the drive shaft 22 and the impeller 70 lies more critically in the precision configuration of the core 60 as compared with other embodiments described heretofore.

Figure 19:
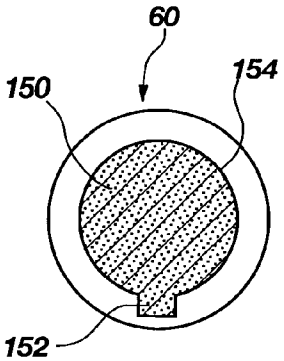
FIG. 19 is a view in axial cross section of the core shown in FIG. 18 taken at line 19—19 thereof.
Figure 18:
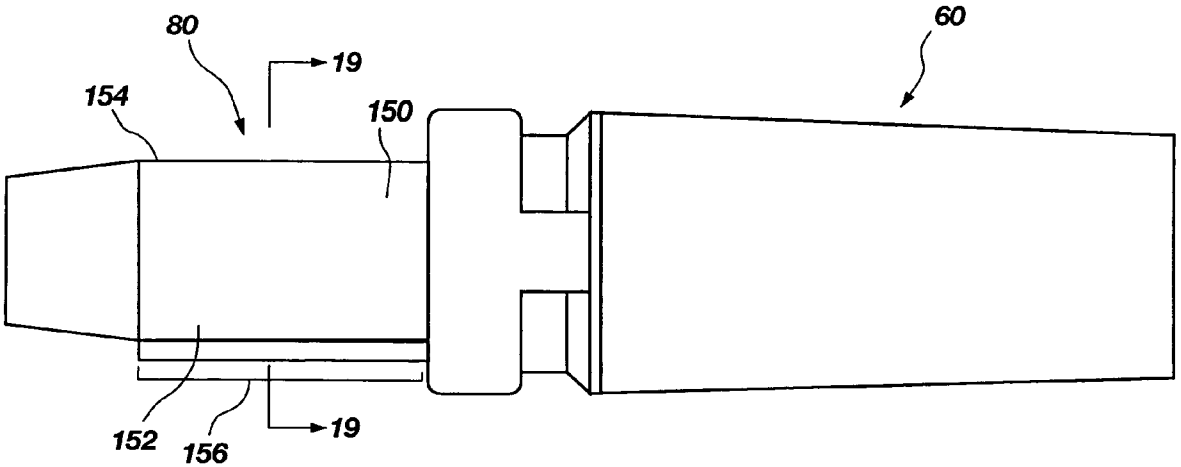
FIG. 18 is a view in elevation of a fourth embodiment of the core of the present invention.

FIGS. 18 and 19 illustrate a fourth embodiment of the core 60 of the present invention where the first region 80 of the core 60 is configured with a substantially cylindrical portion 150. In this embodiment, the first region 80 is further configured with a linear projection 152 which extends outwardly from the surface 154 of the cylindrical portion and extends a selected length 156 of the cylindrical portion 150. In the embodiment shown, the linear projection 152 extends the full length 156 of the cylindrical portion 150, but may be less than the full length 156. The configuration of the core 60 shown in FIGS. 18 and 19 produces a drive side portion 74 of the central opening 72 that is substantially cylindrical and has a keyway 160 formed in the surface 162 of the drive side portion 74 as shown in FIG. 20.

Figure 20:
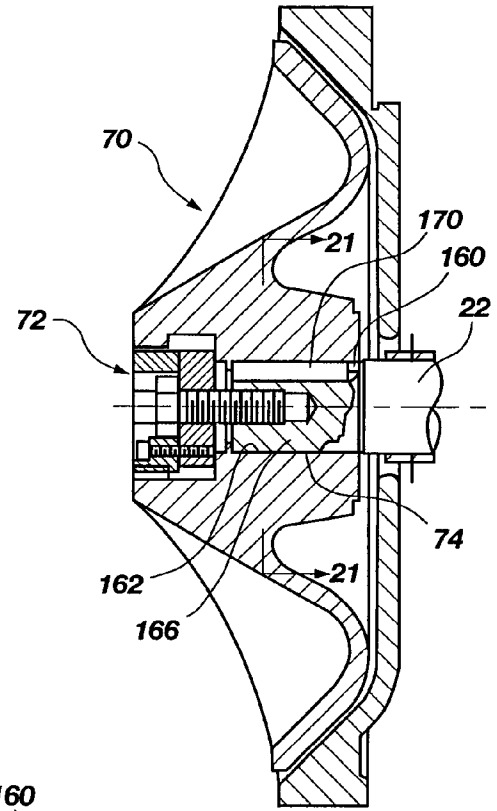
FIG. 20 is a view in radial cross section of an impeller, the central opening of which is formed by the core shown in FIGS. 18 and 19.
Figure 21:
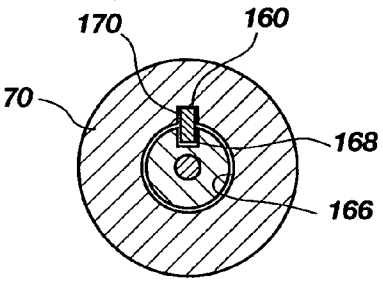
FIG. 21 is a view in axial cross section of the impeller shown in FIG. 20 taken and line 21—21 thereof.

In the embodiment of the impeller 70 of the present invention shown in FIGS. 20 and 21, the terminal end 166 of the drive shaft 22 is substantially circular in axial cross section and is formed with a keyway 168 that is located for alignment with the keyway 160 formed in the impeller 70. At assembly, a key 170, here shown as constituting a bar of rectangular cross section, is inserted to be received in both the keyway 160 of the impeller 70 and the keyway 168 of the drive shaft 22. In this embodiment, contact is made between the surface 162 of the central opening 72 and the outer surface 172 of the terminal end 166 of the drive shaft 22 to provide a primary drive mechanism in rotation of the impeller 70. The key 170 extending between the impeller 70 and the drive shaft 22 provides a secondary drive mechanism.

Figure 22:
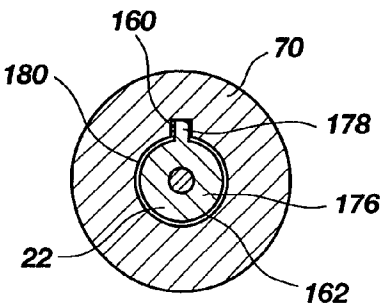
FIG. 22 is a view in axial cross section of an alternative embodiment of an impeller formed by core shown in FIGS. 18 and 19.

FIG. 22 illustrates a further means of connecting the impeller 70 illustrated in FIG. 20 with a drive shaft 22. In this embodiment, the terminal end 176 of the drive shaft 22 is cylindrical in axial cross section and is formed with a spline 178 that extends outwardly from the outer surface 180 of the terminal end 176 of the drive shaft 22. The spline 178 is sized and shaped to be received in the keyway 160 of the impeller 70. Again, contact between the surface 162 of the impeller 70 and the outer surface 180 of the terminal end 176 of the drive shaft 22 provides a primary drive mechanism for rotating the impeller 70. The interaction of the spline 178 and keyway 160 provide a secondary drive mechanism.

Figure 23:
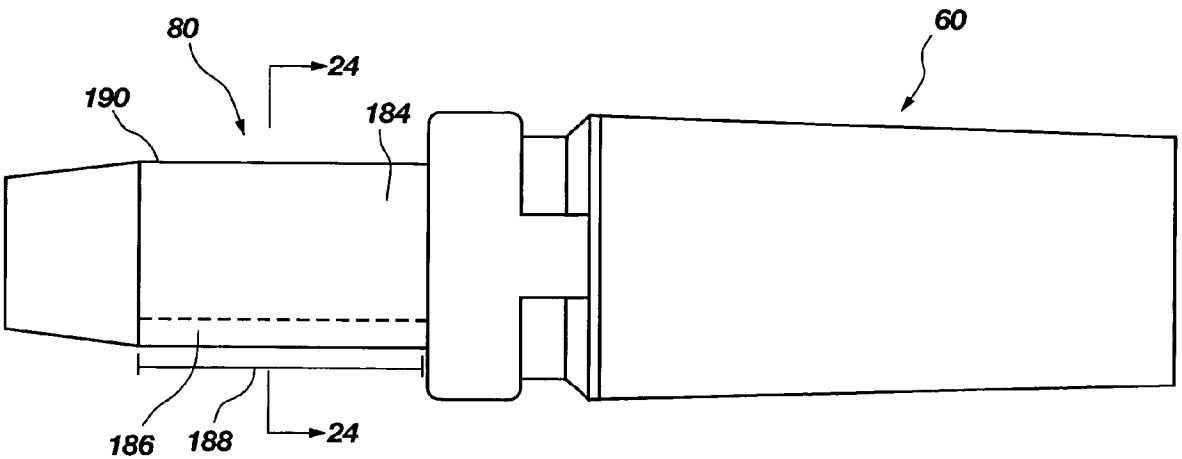
FIG. 23 is a view in elevation of a fifth embodiment of the core of the present invention.
Figure 24:
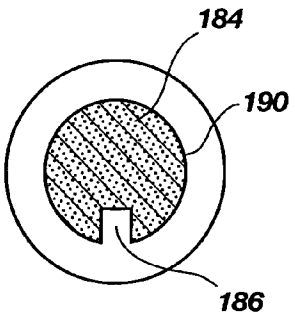
FIG. 24 is a view in axial cross section of the core shown in FIG. 23 taken at line 24—24 thereof.

FIGS. 23 and 24 illustrate a fifth embodiment of the core 60 of the present invention where the first region 80 of the core 60 is configured with a substantially cylindrical portion 184. A linear channel 186 is formed along a selected length 188 of the cylindrical portion 184 extending inwardly from the surface 190 thereof. The channel 186 is shown as extending the full length 188 of the cylindrical portion 184, but the channel 186 may extend less than the full length 188. FIG. 24 illustrates in axial cross section the configuration of the first region 80 of the core 60 shown in FIG. 23.

Figure 25:
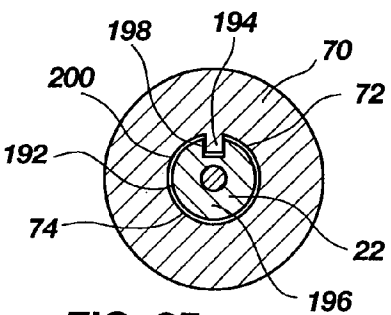
FIG. 25 is a view in axial cross section of an impeller, the central opening of which is formed by the core shown in FIGS. 23 and 24.

FIG. 25 illustrates an axial cross section of an impeller 70 of the present invention where the drive side portion 74 of the central opening 72 is formed by the core 60 shown in FIGS. 23 and 24. The drive side portion 74 is formed with a substantially circular surface 192, but is further configured with a spline 194 produced in the casting by the channel 186 of the core 60. The terminal end 196 of the drift shaft 22 is consequently configured with a keyway 198 that is sized to receive the spline 194 formed in the impeller 70. The contact between the surface 192 of the of the drive side portion 74 of the impeller 70 central opening 72 and the outer surface 200 of the terminal end 196 of the drive shaft 22 provides a primary drive mechanism in rotation of the impeller 70. The interaction of the spline 194 in the keyway 198 of the drive shaft 22 provides a secondary drive mechanism for rotation.

Because the core formation method of the present invention allows the core to be more precisely shaped or configured than was possible in prior art methods, it should be noted that first region 80 of the core 60 may be other than cylindrically-shaped in axial cross section as shown in the fourth and fifth embodiments of the core described previously. That is, the first region 80 of the core may be any suitable size, dimension or shape, including square, rectangular, triangular, hexagonal, oval, bilobular, etc., when viewed in axial cross section.

Additionally, with respect to those embodiments of the invention which employ a spline or key and keyway as a secondary drive mechanism, it should be noted that the first region 80 of the core 60 need not be limited to a cylindrical portion as previously described. For example, as shown in FIG. 26, the first region 80 of the core 60 may be conical in shape and may be configured with either a linear projection 202, thereby producing a core 60 having an axial cross section as shown in FIG. 19, or having a linear channel 204 (shown in phantom in FIG. 26), thereby producing a core 60 having an axial cross section as shown in FIG. 24.

Figure 27:
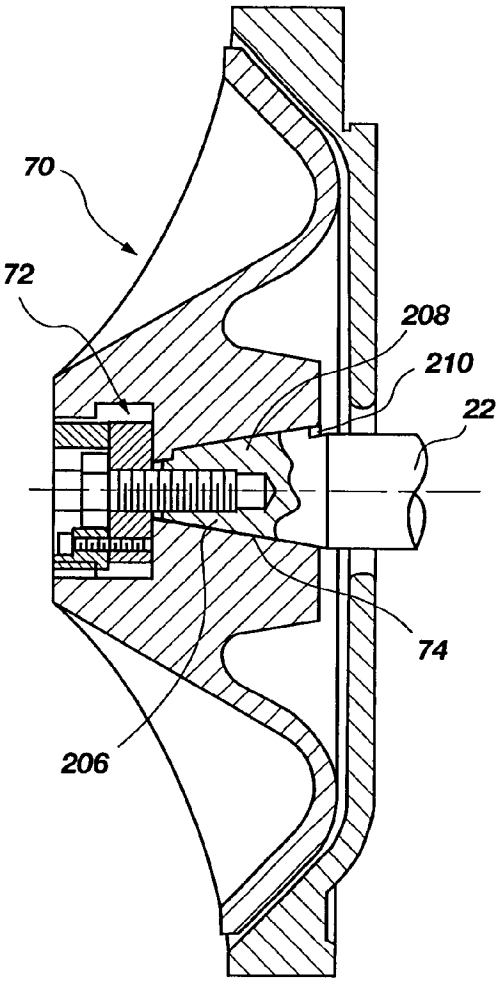
FIG. 27 is a view in radial cross section of an impeller of the present invention, the central opening of which is formed by the core shown in FIG. 26.
Figure 26:
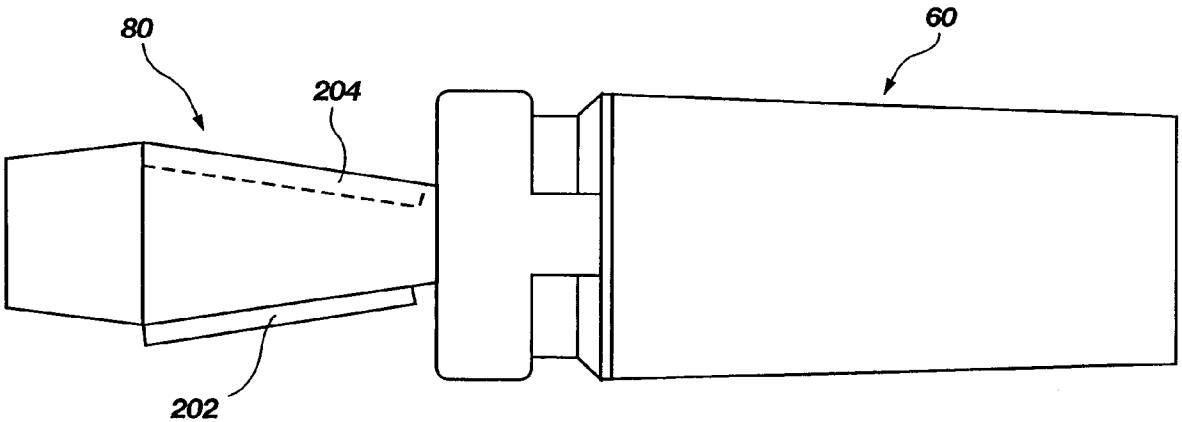
FIG. 26 is a view in elevation of a sixth embodiment of the core of the present invention.

The impeller 70 cast from the core 60 shown in FIG. 26 is shown in FIG. 27 and would have the same general elements of configuration as described with respect to FIG. 20, except that the drive side portion 74 of the central opening 72 is conical in shape and is configured to receive a drive shaft 22 having a terminal end 206 that is similarly conical in shape, having a keyway to receive a spline formed in the impeller or, alternatively as shown, a spline 208 to interactingly fit with a keyway 210 formed in the impeller 70 as shown.

Figure 29:
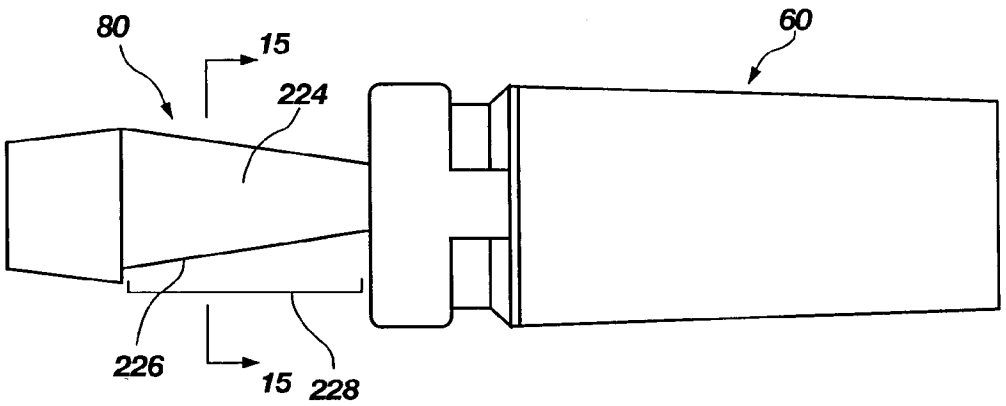
FIG. 29 is a view in elevation of a seventh embodiment of the core of the present invention used to form the impeller shown in FIG. 28.
Figure 28:
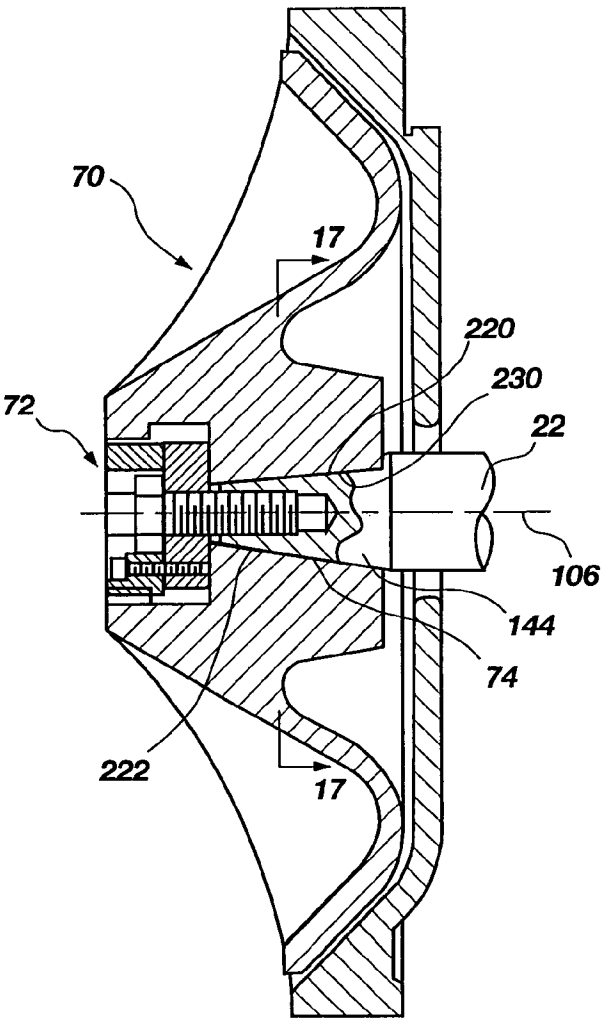
FIG. 28 is a view in axial cross section of a seventh embodiment of the impeller of the present invention.

The embodiment shown in FIG. 16 illustrates an impeller 70 having a central opening 72 configuration which includes a flat surface 142 that extends only partially along the length of the tapered portion 140 of the central opening 72. In an alternative embodiment shown in FIG. 28, the flat surface 220 may extend a length essentially equal to the length of the tapered portion 222 of the central opening 72. The core 60 used in casting the central opening 72 of the impeller 70 is shown in FIG. 29 where the first region 80 of the core 60 is generally conically shaped with a single tapered portion 224 similar to the core embodiment shown in FIG. 14. However, a flat surface 226 is formed along the length 228 of the single tapered portion 224. In axial cross section, the single tapered portion 224 appears as shown in FIG. 15. Referring again to FIG. 28, the terminal end 144 of the drive shaft 22 is similarly configured with a tapered end having a flattened surface portion 230 that is positioned to contact the flat surface 220 of the drive shaft portion 74 of the impeller 70. The axial cross section of the impeller 70 is as shown in FIG. 17.

The method of core formation and impeller casting disclosed herein may be used to form any type or configuration of impeller that is made of very hard material (i.e., greater than 570 Bhn), and is not limited to use in the formation of cupped vortex impellers as has been described herein as merely exemplar. Thus, the configuration of the core and the resulting configuration of the central opening of the impeller may be modified and adapted to any type or style of impeller for a centrifugal pump. Therefore, reference herein to specific details of the core and impeller configurations are by way of example only and not by way of limitation.

What is claimed is:

1. An impeller for a centrifugal pump, comprising:

a hub cast from very hard material having a hardness equivalent to at least 570 Bhn on the Brinell hardness scale, said hub having a drive side and a suction side and an axis extending therebetween;

at least one vane positioned relative to said hub to receive fluid for processing;

a central opening cast in said drive side of said hub having a selected and precisely formed configuration and dimension providing a contact surface for directly receiving and contacting the end of a drive shaft of a motor without machining or babbitting said central opening, said contact surface extending axially a distance from proximate said drive side to proximate said suction side of said hub.

2. The impeller of claim 1 wherein said central opening is configured with a first tapered surface extending from said drive side toward said suction side in a direction toward said axis of said hub.

3. The impeller of claim 2 wherein said first tapered surface lies in a plane which intersects with a plane formed through said axis at an angle of between five degrees and ten degrees.

4. The impeller of claim 3 wherein said central opening is further configured with a flat portion having a surface that is spaced from said first tapered surface in a direction toward said axis.

5. The impeller of claim 2 wherein said central opening is further configured with a second tapered surface which is axially spaced from said first tapered surface in a direction away from said axis of said hub.

6. The impeller of claim 5 wherein said second tapered surface lies in a plane which intersects said axis at an angle which ranges from about five degrees to about ten degrees.

7. The impeller of claim 5 wherein said central opening if further configured with a flat portion formed along a portion of said second tapered surface, said flat portion having a surface which is spaced from said second tapered surface in a direction toward said axis of said hub.

8. The impeller of claim 2 wherein said central opening is further configured with a projection extending away from said first tapered surface in a direction toward said axis of said hub, said projection extending a distance between said drive side of said hub and said suction side of said hub.

9. The impeller of claim 2 wherein said central opening is further configured with a channel formed in said first tapered surface extending a distance between said drive side of said hub and said suction side of said hub.

10. The impeller of claim 1 wherein said central opening is configured with at least one inner surface which is substantially parallel to said axis and wherein said contact surface is further configured as a spline projecting from said at least one inner surface of said central opening toward said axis.

11. The impeller of claim 10 wherein said central opening is substantially circular in axial cross section.

12. The impeller of claim 1 wherein said central opening is configured with at least one inner surface which is substantially parallel to said axis of said hub and wherein said contact surface is further configured as an axially extending channel formed in said at least one inner surface of said central opening.

13. The impeller of claim 12 wherein said central opening is substantially circular in axial cross section.

14. A core for use in casting the central opening portion of an impeller for a centrifugal pump, comprising:

a generally cylindrical body of selected length having a first end for connection to an impeller mold and a second end distanced from said first end for connection to another impeller mold;

a central axis extending between and first end and said second end; and a first region positioned between said first end and said second end selectively configured to determine the configuration and dimension of that portion of the central opening of a very hard material impeller casting which is positioned to receive the drive shaft of a motor.

15. The core of claim 14 further comprising a second region selectively configured to determine the configuration and dimension of a suction side portion of the central opening of an impeller casting.

16. The core of claim 14 wherein said first region is configured with a first conical portion.

17. The core of claim 16 wherein said first conical portion of said first region has a first surface lying in a plane which intersects a plane formed through said central axis at an angle between about five degrees and about ten degrees.

18. The core of claim 17 wherein said first region is further configured with a flat portion having a surface which is spaced apart from said first surface of said first conical portion in a direction toward said central axis.

19. The core of claim 16 wherein said first region is further configured with a second conical portion positioned adjacent said first conical portion, said second conical portion having a second surface which is spaced from said first surface of said first conical portion.

20. The core of claim 19 wherein said second surface of said second conical portion lies in a plane which intersects a plane formed through said central axis at an angle between about ten degrees and about ten degrees.

21. The core of claim 19 wherein said second conical portion of said first region is further configured with a flat portion having a surface which is spaced from said second surface of said second conical portion in a direction toward said central axis.

22. The core of claim 16 wherein said first conical portion is further configured with a projection extending outwardly from said first surface thereof and extends an axial distance along said first surface of said first conical portion.

23. The core of claim 16 wherein said first conical portion is further configured with a channel extending inwardly from said first surface thereof and extends an axial distance along said first surface of said first conical portion.

24. The core of claim 14 wherein first region of said core is configured with at least one surface which is substantially parallel to said central axis and is further configured with a projection extending out from said at least one surface in a direction away from said central axis.

25. The core of claim 24 wherein said first region is substantially circular in axial cross section.

26. The core of claim 14 wherein said first region of said core is configured with at least one surface which is substantially parallel to said central axis and is further configured with a channel extending inwardly from said at least one surface in a direction toward said central axis.

27. The core of claim 26 wherein said first region is substantially circular in axial cross section.

28. The core of claim 14 wherein said core is made of sand.

29. The core of claim 14 wherein said core is made of ceramic.

30. The core of claim 14 further comprising a first core print positioned at said first end of said core and a second core print positioned at said second end of said core, said first core print having a length which is from about three to about five times the length of said second core print.

31. The core of claim 30 wherein said first core print is substantially cylindrical, having a circumferential surface which tapers at an angle away from said central axis in a direction from said first end of said core toward said second end.

32. The core of claim 31 wherein said second core print has a circumferential surface with tapers at an angle away from said central axis in a direction from said second end of said core toward said first end.

33. The core of claim 32 wherein said angle of taper of circumferential surface of said first core print is less than said angle of taper of said circumferential surface of said second core print.

34. A method for casting an impeller for a centrifugal pump, comprising:

providing an impeller mold defining the external shape and configuration of an impeller for a centrifugal pump, said mold being formed with a first core print cavity having a selected length and a second core print cavity having a selected length, the length of said first core print cavity being greater than said length of said second core print cavity providing a core selectively configured to define the configuration of a central opening of an impeller casting, said core having a first core print and a second core print and a central axis extending therebetween;

positioning said first core print of said core in said first core print cavity of said impeller mold;

positioning said second core print of said core in said second core print cavity of said impeller mold;

pouring molten material into said mold and about said core to form an impeller casting, said molten material having a cured hardness the equivalent of at least 570 Bhn on the Brinell hardness scale;

removing said impeller casting from said mold and removing said core when said molten material has hardened; and fitting said configured central opening of said cast impeller to the drive shaft of a motor.

35. The method according to claim 34 further providing a core which is formed from sand having a selected grain size to determine the surface finish of the central opening of the cast impeller.

36. The method according to claim 34 further providing in said core a first core print having a length and a second core print having a length, the length of said first core print being from between about three and about five times that of said second core print.

37. The method according to claim 36 further providing in said core a first core print having a circumferential surface which tapers at an angle away from said central axis in a direction from a first end of said core toward a second end or said core, and further providing in said core a second core print having a circumferential surface which tapers at an angle away from said central axis in a direction from said second end of said core toward said first end of said core.

38. The method according to claim 37 wherein said angle of taper of said circumferential surface of said first core print is less than said angle of taper of said circumferential surface of said second core print of said core.

* * * * *